US005538625A

United States Patent [19]

Sigaud et al.

[11] Patent Number: 5,538,625

[45] Date of Patent: Jul. 23, 1996

[54] PROCESS AND APPARATUS FOR THE STEAM CRACKING OF HYDROCARBONS IN THE FLUIDIZED PHASE

[75] Inventors: Jean-Bernard Sigaud, Vaucresson; Jean-Louis Mauleon, Marley-Le-Roi, both of France

[73] Assignee: Total Raffinage Distribution S.A., Levallois, France

[21] Appl. No.: 836,330

[22] Filed: Apr. 10, 1992

[51] Int. Cl.[6] ..... C10G 9/32

[52] U.S. Cl. ..... 208/127; 585/648

[58] Field of Search ..... 208/126, 127, 208/132; 422/145; 585/648

[56] References Cited

U.S. PATENT DOCUMENTS

| | | | |
|---|---|---|---|
| 2,906,695 | 9/1959 | Boston | 208/127 |
| 3,579,601 | 5/1971 | Kevlon | 208/132 |
| 4,061,562 | 12/1977 | McKinney et al. | 208/127 |
| 4,213,848 | 7/1980 | Saxton | 208/127 |
| 4,259,177 | 3/1981 | Veda et al. | 208/127 |
| 4,405,445 | 9/1983 | Kovach et al. | 208/127 |
| 4,552,645 | 11/1985 | Ceartside et al. | 208/127 |
| 4,716,958 | 1/1988 | Walters et al. | 422/147 |
| 4,818,372 | 4/1989 | Mauleon et al. | 280/113 |
| 4,836,909 | 6/1989 | Matsuo et al. | 208/67 |
| 5,045,176 | 9/1991 | Walters et al. | 208/127 |
| 5,139,650 | 8/1992 | Lenglet | 208/132 |
| 5,151,423 | 12/1992 | Kruse | 208/113 |

*Primary Examiner*—Helane Myers
*Attorney, Agent, or Firm*—A. Thomas S. Safford

[57] ABSTRACT

The present invention relates to a steam cracking process and apparatus which permits the conversion of fractions of petroleum hydrocarbons. The claimed invention provides for the conversion of at least one light hydrocarbon fraction, as well as a heavier hydrocarbon feedstock. The inventive process takes place at a high temperature and in the presence of a dilute fluidized phase of heat-transfer particles. The process comprises contacting the light-hydrocarbon feedstock and then the heavier feedstock, in a sequential manner with catalytic or noncatalytic heat-transfer particles in a continuous flow reactor. The process further provides for separating and stripping, to separate at least 90 percent of the particles which are regenerated before recycling. The process also provides for the separation of the effluent hydrocarbons which are quenched by cold feedstock and/or recycled residue (optionally supplemented by fresh particles) and thereafter recovered by fractionation distillation with at least a portion of the residue fraction being recycled to the downstream portion of the reactor.

21 Claims, 3 Drawing Sheets

PROCESS AND APPARATUS FOR THE STEAM CRACKING OF HYDROCARBONS IN THE FLUIDIZED PHASE

The present invention relates to a steam-cracking process and apparatus permitting the conversion of fractions of petroleum hydrocarbons, in the fluidized phase of heat-transfer particles and at high temperature, with a view to producing olefins, and more particularly olefins having from two to four carbon atoms, butadiene, and monoaromatic compounds such as benzene, or which may be branched, such as toluene, the xylenes, etc.

BACKGROUND OF THE INVENTION

It is known that hydrocarbon cracking processes are commonly employed in the petroleum and allied industries. They consist of breaking down the hydrocarbon molecules into smaller molecules by raising the temperature. There are two types of cracking, thermal cracking and catalytic cracking, which utilize either the effect of temperature alone or then the active sites of a catalyst.

In a conventional thermal cracking unit, the hydrocarbon feedstock is gradually heated in a tubular furnace. The thermal cracking reaction takes place mainly in the portion of the tubes receiving the maximum heat flow, where the temperature is determined by the nature of the hydrocarbons to be cracked.

In the visbreaking processes, in which only the heaviest molecules are broken down into smaller molecules, the cracking temperature ranges from 450° to 600° C., as the case may be.

When the molecules to be thermally cracked are lighter molecules, such as gasolines or liquefied petroleum gases (LPG), and light olefins and monoaromatic compounds are to be produced, the necessary temperature is much higher and generally ranges from 780° to 850° C., depending on the type of feedstock to be cracked, but is limited by the operating conditions of the process and by the operating complexity of the furnaces, which use supplementary heating energy.

Obtaining and maintaining the necessary temperature levels is all the more difficult as unwanted coke gradually deposits on the walls of the tubes and the heat flow is reduced. Moreover, a wall temperature that is higher than the process temperature accounts for the formation of coke and of breakdown products of the gum and acetylene-compound type. The coke detracts from the quality of the heat transfer. It results in a buildup of the pressure drop within the tubes and in an increase in the skin temperature which imposes excessive mechanical stresses that lower the conversion rate of the hydrocarbon feedstock entering the thermal cracking unit and entails periodic decoking outages. This also means that the process should be modular, to permit decoking on-stream, and that the feedstocks to be treated should be "clean" so that the duration of the cycles between two decoking operations is not too short. In practice, the feedstocks are limited to liquefied petroleum gas, gasolines, and certain well-suited or hydrotreated gas oils.

Moreover, the heat transfer within a tube is not instantaneous and the thermal cracking reaction is highly endothermic. This gives rise to problems of temperature control and maintenance, and hence of selectivity, which are very difficult to solve.

To overcome these drawbacks and carry out the thermal cracking of hydrocarbons, it has long been proposed to employ the fluidized-bed technique.

For example, U.S. Pat. No. 3,074,878 (Esso) and European patent application 26,674 (Stone) use a fluidized-phase tubular reactor with downflow of the heat-transfer particles, with a short contact time, to perform the thermal cracking of petroleum feedstocks, owing to a heat input supplied by the combustion of the coke deposited on the heat-transfer particles.

And U.S. Pat. No. 4,427,538 (Engelhard) employs a tubular reactor to carry out a low-severity cracking, and the elimination of the heaviest hydrocarbons contained in the feedstock, by means of a fluidized-phase reaction with upflow of inert heat-transfer particles.

However, none of these techniques is able to permit, under satisfactory industrial conditions, the simultaneous conversion to light olefins and to monoaromatic compounds of several fractions of petroleum hydrocarbons, such as liquefied petroleum gases, gasolines, or, much less, strongly contaminated residual feedstocks.

In fact, the thermal cracking of petroleum hydrocarbon fractions which include light paraffins such as butanes, propane, and especially ethane or of petroleum fractions such as gasolines, naphthas and gas oils requires that the reaction temperature be maintained at a very high level, generally on the order of from 750° to 850° C., for a very short but closely controlled time. In the absence of precise control of the residence time in that temperature zone, molecules of olefins formed during the conversion may polymerize to the detriment of the overall selectivity of the reaction. Now it has been found that the separation systems used up to now to separate the reaction effluents from the heat-transfer particles do not generally permit a sufficiently rapid separation and quenching of the effluents, with the result that some of the molecules formed may continue to react and to polymerize.

This poses a constant risk of clogging and fouling in the separating and stripping zone as well as of the piping for the effluent hydrocarbons between that zone and the fractionating zone.

Moreover, maintenance of the gas phase at the temperatures desired for thermal cracking requires an instantaneous and very substantial heat input because of the high endothermicity of the thermal conversion by steam cracking and because a rather sizable quantity of steam is injected into the reaction zone for the purpose of lowering the partial pressure of the hydrocarbons and of minimizing the production of coke. Furthermore, when light hydrocarbon fractions are being steam-cracked to olefins and monoaromatic compounds, the amount of coke deposited on the heat-transfer particles is altogether insufficient to maintain the heat balance of the system and makes necessary the systematic input of external energy.

Finally, the heat balance and the temperature level to be attained impose very high temperatures on the heat-transfer mass. Now because of technological difficulties due in part to the metallurgy of the equipment involved, only the most recent techniques permit the necessary quantities of heat-transfer particles to be provided at a sufficiently high temperature.

OBJECTS OF THE INVENTION

The present invention seeks to overcome these drawbacks by proposing a process for the conversion by steam cracking at high temperature of petroleum hydrocarbon fractions to olefins such as ethylene, propylene and butenes, butadiene and monoaromatic compounds by introducing these fractions into a dilute fluidized phase of heat-transfer particles and high-temperature steam under well-defined reaction conditions of fluidization, temperature and duration.

The invention further seeks to make possible a satisfactory conversion, by cracking of the fractions introduced into the reactor, with a high selectivity for light olefins, budadiene, and monoaromatic compounds.

Moreover, the invention seeks to permit effective control of the polymerization reactions of the reaction products.

Finally, the invention seeks to limit the production of coke to the quantity necessary for satisfying the heat balance of the unit.

SUMMARY OF THE INVENTION

To this end, the invention has as a preferred embodiment a process for the conversion by steam cracking, at high temperature and in the presence of a dilute fluidized phase of essentially heat-transfer particles, of at least one light hydrocarbon fraction with low metal contamination whose boiling point is below about 400° C. as well as of a heavier hydrocarbon feedstock consisting essentially of compounds whose boiling point is above about 400° C., said process comprising a stage of contacting said fraction, and then said feedstock, in a staggered manner and at decreasing severity, with catalytic or noncatalytic heat-transfer particles in a continuous-flow reactor of the tubular upflow or downflow type, and a stage of separation and stripping permitting the separation of at least 90 percent of said particles, which are then regenerated, preferably by combustion of the coke deposited on them, before being recycled at a higher temperature to the inlet of the continuous-flow reactor, as well as of the effluent hydrocarbons, which are recovered after a stage of fractional distillation, this process being characterized in that at least one fraction of the heavier hydrocarbon feedstock is injected between the stage of separation of the particles and effluent hydrocarbons and the fractionation stage, and in that at least a portion of the residue from the stage of fractionation by distillation is recycled to the downstream portion of the reactor.

The light hydrocarbon fraction or fractions with little contamination distilling at below 400° C. may be advantageously chosen from the group consisting of light paraffins, such as ethane, propane and the butanes, and heavier hydrocarbons such as gasolines, naphthas and gas oils, and even certain higher-boiling but strongly paraffinic or naphthenic fractions, such as the paraffins or slack wax or the hydrocarbon recycles. These hydrocarbon fractions may come from different units of the refinery, such as the atmospheric distillation, visbreaking, hydrocracking, oil manufacturing or olefin oligomerization units, or from the effluents of the conversion unit itself. Moreover, the various fractions may be injected either alone or in combination with steam and optionally other fluidizing gases such as hydrogen or light gases.

In accordance with a particularly advantageous operating mode, steam cracking is preferably carried out in the continuous-flow reactor in several zones of decreasing severity by successive injections, in the presence of steam and/or of gaseous fluids, of several distinct fractions, the first of which should have a lower boiling point than the next one. In fact, this temperature profile is particularly advantageous for optimization of the selectivity of the reactions taking place. For example, there might be successively injected a first fraction containing mainly ethane, then possibly propane and butane, then, in the liquid phase, a fraction containing light gasolines, then possibly naphthas or gas oils, and finally the heavier hydrocarbon feedstock having a boiling point above about 400° C. The latter might be advantageously chosen from the group consisting of the residues from atmospheric or vacuum distillation, pitches from deasphalting, catalyst slurries, or synthetic hydrocarbons. These feedstocks may therefore be very heavy feedstocks containing hydrocarbons whose boiling point may be as high as 750° C. and higher and whose gravity may range from 0° to 25° API. Depending on the desired temperature profile and the heat-balance requirements, the quantity injected of these heavy hydrocarbon feedstocks may advantageously represent from 0.25 to 4 times the quantity of light fraction injected upstream.

In the most elaborate configuration, which includes successive injections of steadily heavier fractions, for example, ethane or liquefied petroleum gas, then gasoline or gas oil, and finally of the heavier feedstock of the distillation-residue type into the downstream zone of the continuous-flow reactor, the latter actually comprises several distinct reaction zones operating successively under conditions of decreasing severity (decreasing temperature, decreasing time of contact with the heat-transfer mass, decreasing activity, possibly catalytic, of the heat-transfer mass, and decreasing ratio between the flow rate of that mass and of the hydrocarbons) and adapted to the nature of the feedstocks to be treated and of the products desired. For example, ethane might be converted by cracking in the presence of steam in the injection zone of heat-transfer particles where the temperature is highest (on the order of 850° to 950° C.), that is, in the zone of the continuous-flow reactor that is farthest upstream, then the drop in temperature due to the endothermicity of the reaction might be utilized to inject a propane or butane fraction at a temperature on the order of 800° to 900° C., and so forth until an intermediate hydrocarbon fraction, such as a fraction of the gas oil type or a fraction of light gasolines, is injected. Finally, the new drop in temperature so resulting might be utilized to crack the heavier feedstock, as well as the heaviest residues from the steam-cracking reaction, by recycling all or part of the residue from fractionation to the downstream portion of the reactor under conditions better adapted to its nature.

In the course of its extensive work in this field, the applicants have found that while it is relatively easy to control the conditions of reaction time and temperature in the reactor by treating each injection zone as a quench zone in relation to the preceding zone, this is not the case in the portion of the reaction zone which directly precedes the separation and stripping of the heat-transfer particles. In fact, at the temperature levels required for steam cracking, which are always very high, the separation of gaseous hydrocarbons and solids should proceed practically instantaneously so as to maintain the production of the desired olefins while minimizing the formation of coke and of heavy products through a polymerization reaction.

Until now, fluidized-bed steam cracking thus has presented the following dilemma:

Either the separation system, usually ballistic and often consisting of cyclones, is efficient, the duration of the separation operation then being too long to permit optimization of production and prevention of coking and the formation of contaminants of the acetylene type, or the separation system is instantaneous but less efficient, resulting either in an excessive loss of hydrocarbons due to entrainment of hydrocarbons into the regeneration zone or in excessive entrainment of solid particles by the gaseous effluents, and particularly of fines, whose isolation from the distillates is very costly, the latter then becoming difficult to upgrade, with the risk of undesirable side reactions when the solid particles have some catalytic activity.

The present invention seeks to remedy the problems linked to the formation of coke and of breakdown products in the pipes carrying the reaction effluents from the steam-cracking units to the fractionation zone for these effluents. In fact, to be able to fractionate by distillation the hydrocarbon effluents from conventional steam-cracking units, their temperature has to be reduced greatly, and above all very rapidly, to obtain a fractionating-column inlet temperature below the dew point of these effluents, that is, a temperature at which the heaviest fractions condense. Now it is known that during this drastic reduction of the temperature the heaviest compounds produced by the steam-cracking reaction tend to deposit on the walls of pipes, which entails periodical and costly outages of the steam-cracking units for the decoking of these pipes.

The present invention further permits the aforesaid drawbacks to be remedied since the injection of a major portion of the heaviest feedstock, necessary to the heat balance of the steam-cracking reaction, is effected after the stage of separation of at least 90 percent of the particles and of the hydrocarbons, and before the stage of fractionation by distillation.

This particular mode of injection of the feedstock makes it possible to fully control the conditions of steam-cracking reaction temperature and time, for the following reasons:

The quenching effect necessary to the instantaneous termination of the thermal reactions is provided by atomization of the feedstock itself, which is thus preheated; and this, coupled with the diluting effect of the condensed liquid effluents, permits the effective deactivation of all coke precursors present in the steam-cracking effluents by dissolution in the still liquid petroleum feedstock, this quenching effect being possibly completed before the fractionation stage, either by passing hydrocarbons into a heat exchanger or through a new injection of water, of steam, or of any other hydrocarbon fraction.

From 0.01 to 10 percent, and preferably from 0.05 to 5 percent, of the heat-transfer particles entrained by the reactor effluents provide both for the permanent cleaning of the walls, thus protecting them from fouling, and the absorption of gums as they are being formed in the transfer lines of the effluents to the fractionation zone.

Recycling of the residues from distillation to the downstream portion of the reactor provides not only for the heat balance of the unit and the conversion to olefins and monoaromatics of heavy feedstocks not used up to now in steam cracking but also for the consumption of the heaviest products, which are often difficult to upgrade, until they are used up.

Vaporization then being practically instantaneous and homogeneous, the recycle is thus preheated to a temperature close to its bubble point, which places it in excellent conditions for very selective cracking.

Moreover, the entrained heat-transfer particles can be recycled in their entirety, and it then becomes possible to optimize the rapidity of separation of heat-transfer particles and gaseous effluents without excessive loss of heat-transfer particles, even if this has to be done at the expense of separating efficiency.

In accordance with a particularly advantageous mode of carrying out the present invention, practically instantaneous heat exchange between the heavier hydrocarbon feedstock and the effluents from the steam-cracking reaction is assured by atomizing that feedstock in the liquid state, in a manner known per se. (See in this connection European patent 312,428.) Since the quality of the heat exchange is a function of the exchange surface between liquid and gas, the injector or injectors should be adjusted to permit atomization of the feedstock in droplets with a diameter of less than 200 microns, and preferably less than 100 microns. Advantageously, the injectors are provided with mixing chambers permitting certain quantities of water or steam, or of other petroleum fractions, to be introduced with the feedstock. Furthermore, a substantial quantity of residue from fractionation may be introduced to advantage with the feedstock.

Moreover, the quality of the quench will be optimum if the temperature of the hydrocarbons entering the fractionation zone and resulting from the dissolution of the steam-cracking effluents in the heaviest feedstock to be steam-cracked is below the dew point of the hydrocarbons.

The heat exchange so effected permits the hydrocarbons to be brought in less than 0.3 second, and preferably in 0.1 second, to a temperature which preferably ranges from 300° to 450° C.

In particular, the hydrocarbon feedstock entering the fractionation zone will have a temperature less than 100° C., and preferably less than 50° C., below the temperature corresponding to the bubble point of that feedstock, in other words, the temperature at which it is in the liquid state but at which the first bubbles of gaseous hydrocarbons form.

In accordance with an equally advantageous mode of carrying out the present invention, the production of olefins and monoaromatic compounds can be considerably increased by a judicious reuse of the saturated hydrocarbons produced during the reaction. This can be accomplished simply by separating the olefins from the saturated hydrocarbons in each of the $C_2$, $C_3$, $C_4$ and other fractions produced and recycling the hydrocarbons to the corresponding previously described injection zone of the upstream portion of the reactor.

As a modification, it is also possible to use, for example, the mixture of ethane and ethylene coming from the fractionation zone and sending this mixture to a reactor for the trimerization or oligomerization of the ethylene of the type, for example, described in the prior art (refer, in this connection, to European patents 12,685, 24,971 and 215,609 or to U.S. Pat. No. 4,605,807) to recover, after fractionation of the effluents:

On the one hand, the unreacted ethane, which is recycled to the inlet of the upstream portion of the reaction zone in accordance with the present invention, and, on the other hand, the light gasolines resulting from said oligomerization, which in turn are optionally recycled with other gasolines to the steam-cracking zone operated at lower severity, which will permit the production of propylene and of butenes, if this is what is desired.

An additional advantage accruing from the present invention is that the hydrogen which is necessarily produced by the steam cracking in the upstream portion of the reactor is capable of reacting under the reaction conditions of the downstream portion of the reactor, and hence of improving the selectivity of the effluents from the conversion unit for the products most desired and possibly more stable.

As has been pointed out earlier, the deposition of coke resulting from thermal or catalytic cracking should be minimized for economic reasons but should nevertheless be sufficient to maintain the heat balance in the upstream and downstream portions of the tubular reactor. (In place thereof, the heat balance may be maintained by the introduction of an auxiliary fuel into the regenerator.) Moreover, at least 50 percent, and preferably 80 percent, by weight of the heavy feedstock should preferably have a boiling point above about 400° C. Since this value of about 400° C. is largely based on the cut point of the distillation residues, it may actually range from 300° to 550° C. without departing from the scope of the present invention.

Illustrative of such feedstocks are the vacuum gas oils and the heavier hydrocarbon oils, such as crude petroleums, whether topped or not, as well as the residues from atmospheric or vacuum distillation, pitches, bitumen emulsions, aromatic extracts, catalyst slurries, or synthetic or reclaimed oils. These feedstocks may have undergone a prior treatment, if indicated, such as a hydrotreatment, for example. They may, in particular, contain fractions with boiling points as high as 750° C. and higher, and fractions with a high percentage of asphaltenes, and have a high Conradson carbon content (10 percent and higher). These feedstocks may or may not be diluted with conventional lighter fractions, which may include hydrocarbon fractions that have already undergone a cracking operation and are being recycled, such as LCOs (light cycle oils), whose boiling range usually extends from 160°–220° C. (start of cut) to 320°–380° C. (end of cut) recycled heavy oils, or heavy cycle oils (HCOs), whose boiling range usually extends from 300°–380° C. (start of cut) to 460°–500° C. (end of cut), or even catalyst residues (slurries), a major fraction of which distills above 500° C. In accordance with a preferred mode of carrying out the invention, the feedstocks may advantageously be preheated in a temperature range which generally extends from 100° to 400° C., and preferably close to the bubble point, so as to promote instantaneous and homogeneous vaporization when brought into contact with the hot solid particles.

To carry out the process in accordance with the present invention, inert heat-transfer particles of a type known per se, such as microspheres of kaolin or silicates, may be used. Likewise, all classes of catalysts possessing catalytic cracking capability may be employed. One particularly advantageous class consists of catalysts having a porous structure in which molecules can be contacted with active sites located in the pores. This class includes primarily the silicates or aluminosilicates. In particular, catalysts comprising stable zeolites are commercially available with supports containing a variety of metallic oxides and combinations of such oxides, particularly silica, alumina, magnesia and mixtures of these substances, as well as mixtures of these oxides with clays. The catalyst composition may, of course, contain one or more agents favoring one stage or another of the process. The catalyst may thus contain, in particular, agents promoting the combustion of the coke during regeneration, or agents apt to promote the cyclization of olefins to aromatics (or vice versa), if the production of aromatics becomes a priority object.

In view of the elevated temperatures and of the operating pressure (which usually ranges from 0.3 to 5 kg/cm$^2$), the short residence time of the hydrocarbons in the reaction zone (on the order of a few hundredths to a few tenths of a second), and the conditions of quenching and recycling the feedstock to be cracked, carrying out the process calls for a number of specific means, which are an integral part of the present invention.

The invention thus also relates to an apparatus for the steam cracking, by conversion through direct contact, in a fluidized phase of heat-transfer particles and at high temperature, of petroleum hydrocarbon feedstocks comprising at least one light fraction with low metal contamination whose boiling point is below about 400° C. as well as a heavier hydrocarbon feedstock consisting essentially of compounds whose boiling point is above 400° C., said apparatus comprising a continuous-flow reactor for the contacting at high temperature of petroleum fractions with catalytic or noncatalytic heat-transfer particles, the continuous-flow reactor being of the essentially upflow or downflow tubular type; means, in particular of the ballistic type, adapted to perform the separation of at least 90 percent of said particles and the cracked hydrocarbons; means for stripping the separated particles; means for regeneration, under conditions of combustion of the coke deposited on the particles, with air or steam; and means for recycling the regenerated particles to the inlet of the reactor, as well as means for the fractionation of the gaseous effluents by distillation, said apparatus being characterized in that it comprises on the one hand, between said separating means and said fractionating means, means for injection of a fraction of the heavier hydrocarbon feedstock into the effluents, and on the other hand means for the recycling and injection of a portion of at least the distillation residue in the liquid phase but at a temperature close to its bubble point into the downstream section of the reactor.

Said apparatus may comprise means for the successive injection into the reactor, from upstream to downstream, of light gases comprising ethane, then optionally propane and/or butanes, in such quantity that the temperature of the mixture with the heat-transfer particles is above 800° C., and preferably above 825° C., then of hydrocarbon fractions such as light gasolines and/or optionally naphthas and gas oils in such an amount that the temperature of the resulting mixture directly downstream of the point of injection is above 750° C., and preferably above 800° C., and finally, in the downstream portion of the reactor, in the form of fine liquid droplets with an average diameter of preferably less than 100 microns, the heavier hydrocarbon feedstock or feedstocks.

Like the injectors of feedstock into the effluents, the injectors of recycled residues from fractionation into the downstream portion of the continuous-flow reactor are adapted to permit the atomization of the feedstock into drops of a diameter of less than 200 microns, and preferably less than 100 microns. They are preferably of the wide-neck venturi type (see European patent 312,428 to minimize the attrition problems arising from the presence of recycled heat-transfer particles.

Moreover, certain types of devices for the separation of the steam-cracking effluents which are designed to reduce the transfer time of the effluents to the fractional-distillation zone may advantageously be employed in accordance with the present invention. In particular, when the reactor is operated in the upflow mode (i. e., as a riser), the heat-transfer particles will travel to the reaction zone at high speeds ranging from 20 to 200 meters per second (m/s), and preferably from 40 to 100 m/s, because of the production of a large quantity of gaseous hydrocarbons, and a simple centrifugal-separation device may therefore be used, if desired. The generally costly use of cyclone separators may thus be dispensed with.

BRIEF DESCRIPTION OF THE DRAWINGS

In the specification and in the accompanying drawings, we have shown and described preferred embodiments of the invention and have suggested various alternatives and modifications thereof; but it is to be understood that these are not intended to be exhaustive and that many of the changes and modifications can be made within the scope of the invention. The suggestions herein are selected and included for purposes of illustration in order that other skilled in the art will more fully understand the invention and the principles thereof and will thus be enable to modify it in a variety of forms, each as may be best suited to the conditions of the particular use.

Similarly, when the reactor is operated in the downflow mode (i.e., as a dropper), the heat-transfer particles are collected in a chamber located at the base of the dropper, where they are stripped after having been separated from the steam-cracking effluents simply by ballistic action.

Different modes of practicing the invention are illustrated in the accompanying drawings, which are not limitative, and where

BRIEF DESCRIPTION OF THE FIGURES

Figure 1:
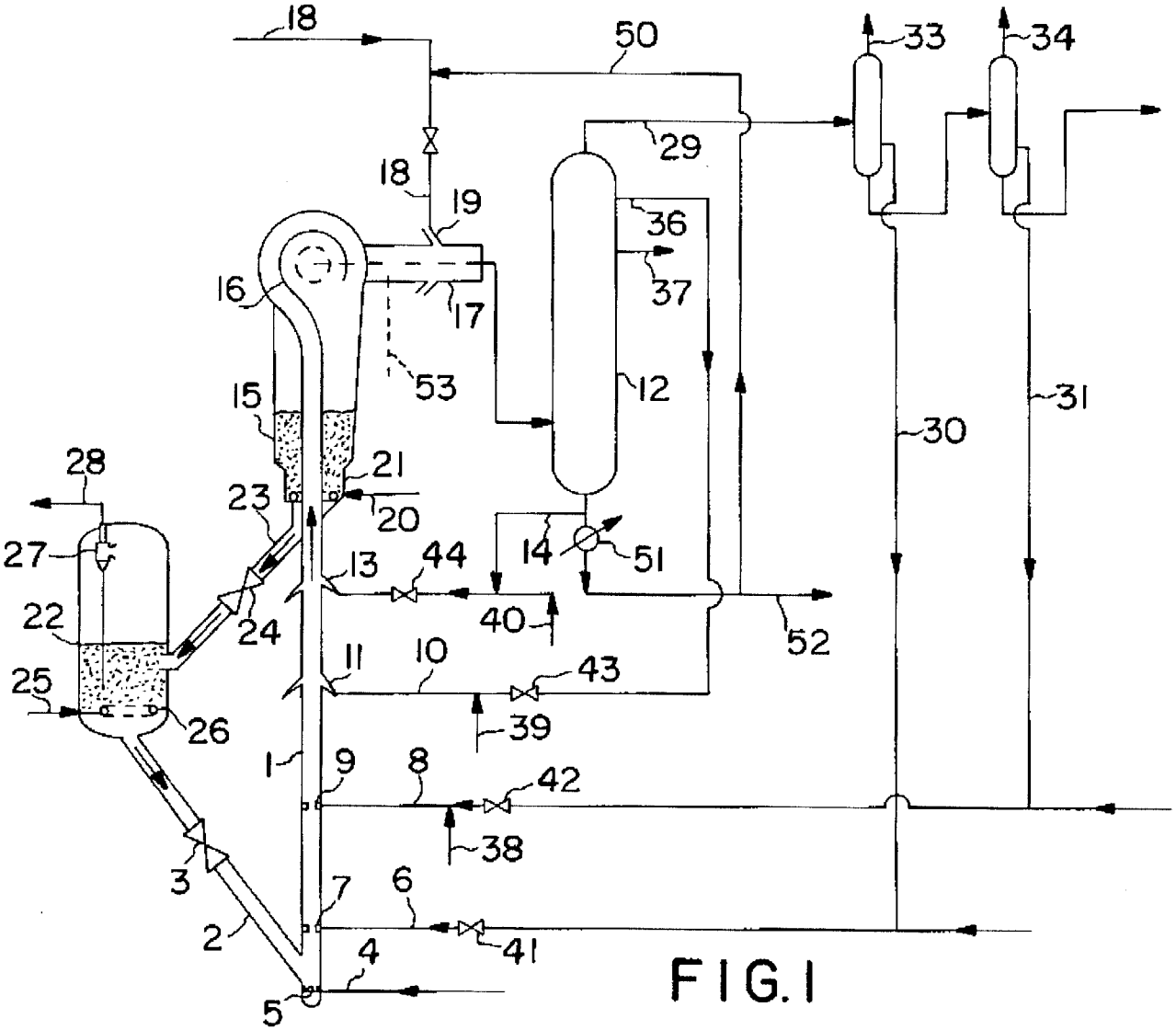
Figure 2:
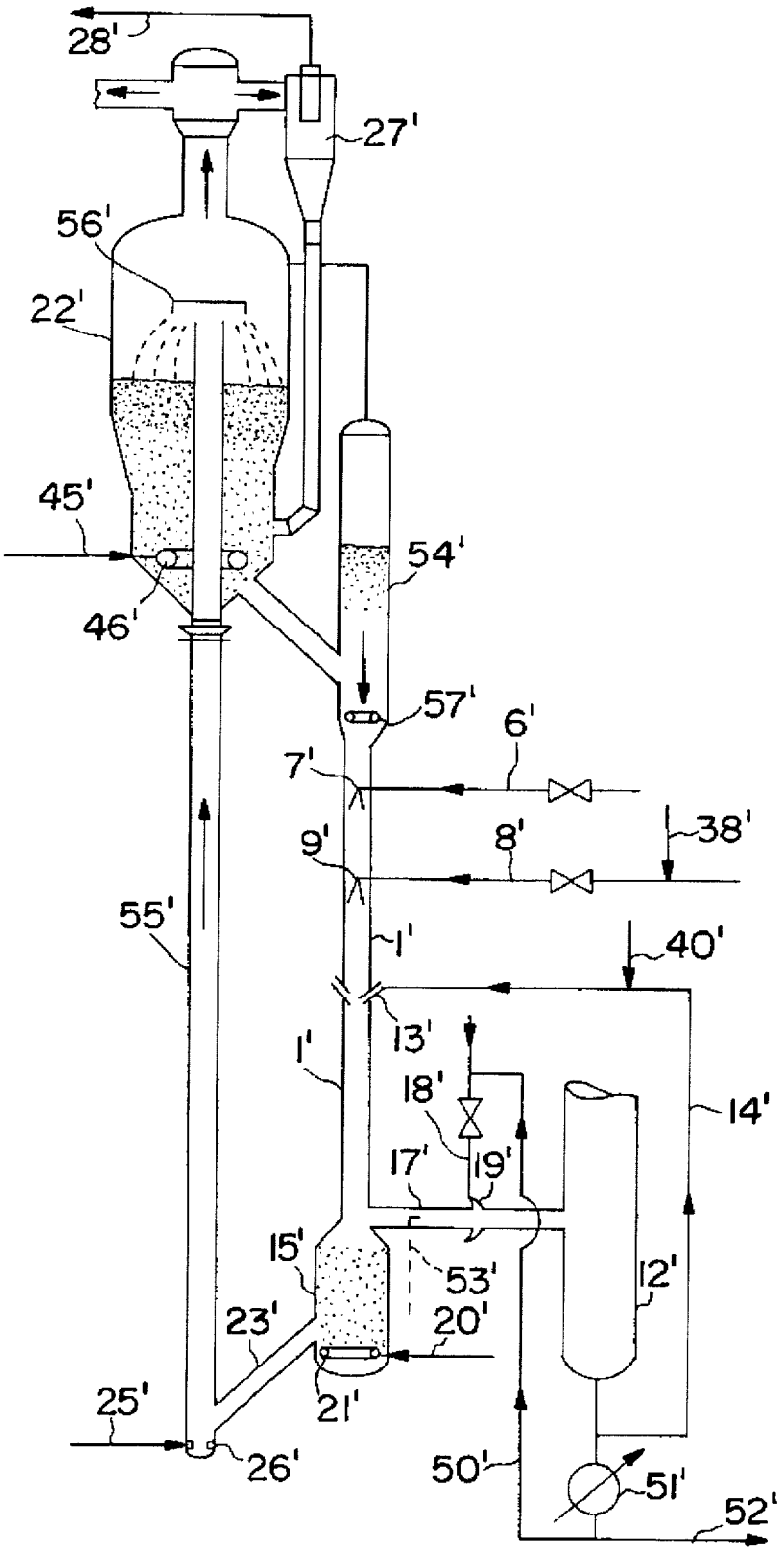
Figure 3:
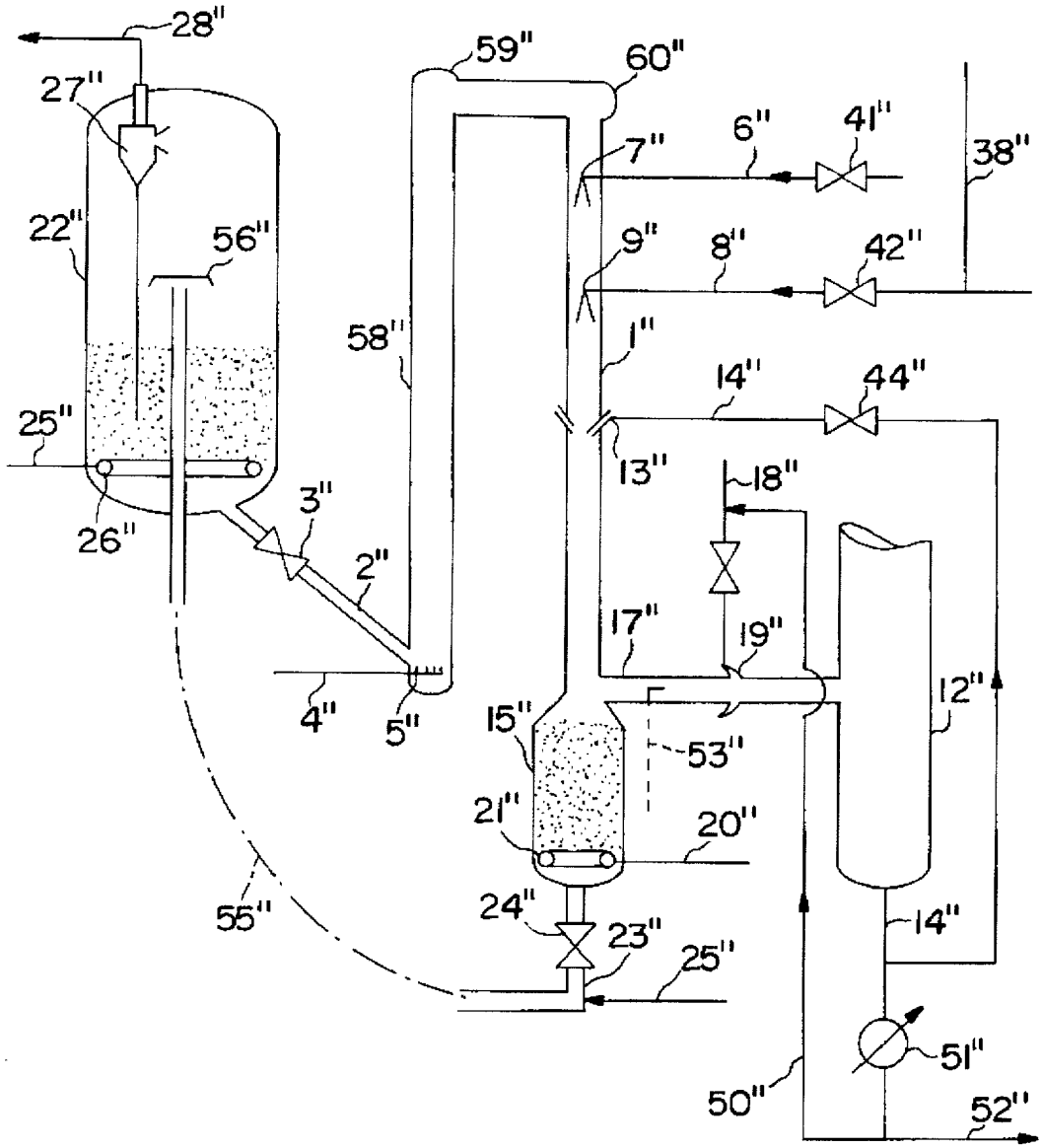

FIG. 1 illustrates the application of the invention to a fluidized-bed steam-cracking unit with an upflow column, or riser, and a single chamber for regeneration at high temperature of the heat-transfer particles that is suitable in particular for the regeneration of contact masses, the ballistic-separation device being provided in this application with a simple centrifugal ballistic-separation device, and FIGS. 2 and 3 illustrate the application of the invention to a steam-cracking unit with an essentially downflow reaction zone, or dropper.

The fluidized-phase upflow steam-cracking apparatus shown diagrammatically in FIG. 1 comprises a riser-type reaction chamber 1. The latter is supplied at its base, through line 2, with regenerated heat-transfer particles in a quantity determined, for example, by the degree of opening or closing of a valve 3. The regenerated particles are fluidized by injection at the base of the riser, by means of a diffuser 5, of steam, or any other suitable gaseous stream, supplied through line 4.

A first line 6 here supplies a diffuser 7, permitting the injection into the upstream portion of the reactor of a saturated light gas such as ethane. A fraction, which here is a propane fraction but might just as well be a butane fraction or a mixture of the two, may then be similarly injected through line 8 by means of the diffuser 9. Finally, a gasoline or gas-oil fraction may here be vaporized by means of an injector 11 supplied by line 10. A distillation-residue feedstock coming from the fractionation zone 12 through line 14 is introduced, optionally in admixture with some fresh feedstock supplied through line 40, by means of an injector 13 into the downstream portion of the reactor under conditions of temperature close to the bubble point of that residue so as to facilitate instantaneous and homogeneous vaporization.

Column 1 opens at its top into an enclosure 15 which, for example, is concentric therewith and in which the separation of reaction effluents and heat-transfer particles by means of a ballistic separator 16 as well as the stripping of the coke-laden particles are carried out. The effluent hydrocarbons are discharged from the centrifugal system 16 through the discharge line 17, into which the cold feedstock supplied through line 18 is sprayed by means of injectors 19 while at least 90 percent of the heat-transfer particles drop to the base of the enclosure 15, where a line 20 feeds a stripping gas, usually steam, to diffusers 21, disposed at regular intervals about the base of the enclosure 15.

The quenching action of the effluents from the steam-cracking reaction, brought about at 17 by the direct contact between the droplets of fresh feedstock and these effluents, is here enhanced by the injection through line 50 of recycled residue from the distillation carried out in the fractionation zone 12. The distillation residue may be cooled by being passed through a heat exchanger 51, and the heat so recovered may be used to generate steam for the whole plant without it being necessary to resort to additional quenching, as is the case with conventional processes. Moreover, the presence of a small quantity of particles or fines of the heat-transfer solid in the reactor effluents provides not only for the effective cleaning of the walls but also provides a means for adsorption of precursors of gums and coke deposits. To this end, the proportion of particles circulating in line 17 can be altered by providing an injector for fresh particles supplied through line 53.

The heat-transfer particles stripped at the base of the enclosure 15 are discharged to a regenerator 22 through a pipe 23 which here is provided with a control valve 24. The regenerator 22 shown in this figure comprises only one zone for combustion, in the presence of oxygen or of steam, of the coke deposited on the heat-transfer particles. This regeneration is carried out so that a large portion of the heat liberated by the combustion of the coke is transferred to the particles to enable them to attain the elevated temperatures required by the reaction in zone 1. The coke deposited on the particles is thus removed with the aid of air injected at the base of the regenerator through line 25, which supplies the diffuser 26. Optionally, additional fuel may be injected to bring the temperature to the desired heat level. The regenerating gas is separated from the heat-transfer particles entrained into the cyclone 27, from which the regenerating gas is discharged through line 28 while the regenerated and hot heat-transfer particles are extracted from the regenerator, from which they are recycled through the pipe 2 to the intake of the riser 1.

Moreover, after the quench through injection of the feedstock at 19, the reaction effluents and the feedstock introduced at 19 are sent through the line 17 to the fractionating apparatus shown diagrammatically at 12, which permits the separation

- through line 29, of the light gases, which may then be treated in another gas-fractionating apparatus, likewise diagrammatic, permitting in particular the separation, in a manner known per se, of the ethane through line 30 and of the propane through line 31;
- through line 36, of a gasoline fraction whose boiling range usually extends from the $C_5$ fraction 200°–220° C.;
- through line 37, of a fraction of the gas-oil type whose boiling range usually extends from 160°–220° C. (start of cut) to 320°–400° C. (end of cut); and, finally,
- through line 14, of a fraction of the distillation-residue fraction containing the heaviest products coming from both the feedstock and the reaction effluents as well as relatively sizable quantities of fines, the boiling point of this residue being between 300° and 550° C., and usually on the order of 400° C.

A portion of this fractionation residue is therefore injected at 13 into the steam-cracking reactor, in accordance with the present invention. After recovering its heat by passing it through the heat exchanger 51, another portion may, if indicated, either be recycled for quenching, through line 50, in admixture with the feedstock to be steam-cracked, or withdrawn from the apparatus through the bleed line 52.

Moreover, the ethane, the propane and the gasoline fraction coming from the fractionating apparatus may be recycled to the reaction section through lines 30, 31 and 36, and then 6, 8 and 10, while the $C_2$ and $C_3$ olefins produced by steam cracking are isolated through lines 33 and 34, respectively.

An essential advantage of this fluidized-phase steam-cracking apparatus is that making good use of the temperature profile in reaction zone 1 permits the selective cracking of several petroleum fractions. In particular:

In the zone where the heat-transfer particles are introduced, where a maximum temperature on the order of 800° C. and higher prevails, steam may be introduced through line 4, and ethane through line 6, either from the fractionating apparatus through line 31 or from another unit of the refinery.

Because of the high energy demand of this reaction (from three to six times higher than that of a catalytic cracking reaction), the temperature of the reaction zone drops considerably, and it then becomes possible to inject downstream heavier saturated hydrocarbons, such as propane (at 8) or butane (at 11), or also light gasolines (at 11) or naphthas, possibly with make-up steam supplied through lines 38, 39 and 40.

Moreover, control systems 41 to 44 may permit the quantities injected into the reaction zone to be adjusted, in a manner known per se, in order to maintain the desired temperature profiles with the aid of heat sensors located for that purposes in said zones.

In comparison with conventional steam cracking, it will be noted that all the energy required by the reaction is supplied at one and the same time by the heat-transfer mass as it mixes with the feedstocks, in other words, at the start of the reaction. The temperature therefore reaches its maximum at that instant and then decreases as a consequence of the endothermicity of the reactions, thus producing a natural quenching effect that is gradual and therefore of diminishing severity, in contrast to conventional processes.

The resulting temperature profile, coupled with the extremely short reaction time made possible by this apparatus, leads to a selectivity of the reaction that is significantly better than the one obtained with conventional processes as well as to the elimination of coke or tar formation on the walls, where the skin temperature is higher.

The fluidized-phase steam-cracking apparatuses shown in FIGS. 2 and 3 are variations of the one of FIG. 1 in which the reaction zone operates in the downflow mode. The reactors are therefore referred to as droppers. The parts of these apparatuses which are the same as in FIG. 1 are here designated by the same reference numerals but primed in the case of FIG. 2 and double-primed in FIG. 3.

According to FIG. 2, a different type of regenerator is used that is better able to withstand the elevated temperatures which steam cracking requires. The flue gases from regeneration leave the unit at 28' after passing through a cyclone 27' that is external to the regeneration chamber 22'. To permit the withdrawal chamber 54' for the regenerated heat-transfer particles to be placed above the dropper, the regeneration chamber 22' is located in the upper portion of the unit, and the particles to be regenerated, coming from the stripping zone through line 23', need to be transported through an upflow column 55'. This transport is effected by fluidization with a gas diffused at 26' through line 25'. During this transport, primary combustion of the coke deposited on the catalyst particles may take place, under conditions known per se, with a fluidization gas containing air or oxygen. The catalyst particles and the fluidizing gas are then separated ballistically by means of device 56' and the catalyst particles are regenerated, in a manner known per se, in chamber 22', where the particles are burnt countercurrently to the oxygen stream with which the diffuser 46' is supplied by line 45'.

The regenerated catalyst particles may be introduced without heat loss into the upstream portion of the reactor 1' in a quantity determined by the feed rate of the diffuser. A device of a type known per se and not shown here provides for the homogeneity of the distribution of the particles. At the outlet of the dropper 1', the particles drop directly into the dense fluidized stripping zone 15' while the hydrocarbon vapors as well as the stripping steam coming from the diffuser 21', supplied through line 20', and the stripped hydrocarbons are discharged practically instantaneously through line 17', where they are immediately quenched by being dissolved in the heavy feedstock which enters the unit through line 18'.

To permit operation in the dropper mode without the need for a costly raising of the regeneration zone 22", in the variation shown in FIG. 3 the regenerated and hot particles coming from line 2" are first transported in the interior of an upflow column 58" through the injection of a fluid such as steam supplied through line 4". After passing through two elbows 59" and 60", at right angles to each other, the particles flow homogeneously inside the dropper 1", into which ethane and gasolines, for example, are injected successively, at 7" and 8". The quenching of the effluents is then carried out through the heavy feedstock at 19", and the distillation residue from the fractionation zone 12" is injected at 13" at a temperature close to its bubble point.

At the outlet of the dropper, the particles are stripped and exit zone 15' through line 23", at the foot of which an injection of a fluid, such as steam or air, permits them to be conveyed through line 55" to the regeneration chamber 22". In the latter, a ballistic separation device 56" permits them to be diverted into the fluidized-bed combustion zone.

The invention may be further illustrated by the following non-limiting example, many apparent variations of which are possible without departing from the spirit thereof.

EXAMPLE

This example demonstrates the advantages of an apparatus in accordance with the present invention, of the type shown in FIG. 3. The tests were run with ethane, a straight-run gasoline fraction, and two feedstocks A and B, namely, an atmospheric-distillation residue and a vacuum-distillation residue of a crude of the Shengli type.

The characteristics of the feedstocks were as follows:

| | GASOLINE | FEEDSTOCK A | FEEDSTOCK B |
|---|---|---|---|
| Density (at 15° C.) | 0.675 | 0.955 | 0.985 |
| Vol. % distilled at 50° C. | 20 | — | — |
| Vol. % distilled at 70° C. | 70 | — | — |
| Vol. % distilled at 100° C. | 99 | — | — |
| Wt. % distilled at 450° C. | — | 20 | — |

-continued

| | GASOLINE | FEEDSTOCK A | FEEDSTOCK B |
|---|---|---|---|
| Wt. % distilled at 550° C. | — | 45 | 10 |
| Wt. % distilled at 650° C. | — | 70 | 55 |
| Paraffins/naphthenes/aromatics, wt. % | 77/17/6 | — | — |
| $H_2$, wt. % | 15.4 | 12.1 | 11.7 |
| S, wt. % | — | 1.0 | 1.3 |
| Total nitrogen, wt. % | — | 0.6 | 0.8 |
| Carbon, wt. % | — | 8.1 | 14.2 |
| Ni + V, ppm | — | 40 | 70 |

The heat-transfer particles used were contact-mass particles consisting of microspheres, mainly of kaolin, with a specific surface of about 10 $m^2/g$ and an average diameter of about 70 microns. The injectors of feedstock into the quench zone and into the reactor were of the type described in European patent application 312,428.

The conditions of the two tests, run first with feedstock A and then with feedstock B, were as follows (extrapolated to 100 t/h of total feedstock):

| | FEEDSTOCK A | FEEDSTOCK B |
|---|---|---|
| Upstream zone of reactor: | | |
| Temperature of regenerate catalyst, °C. | 880 | 880 |
| Feed rate of regenerated catalyst, t/h | 2000 | 2160 |
| Feed rate of steam at 320° C., tons/hour | 15 | 15 |
| Feed rate of ethane, tons/hour | 10 | 10 |
| Temperature of mixture, °C. | 862 | 868 |
| Central zone of reactor: | | |
| Feed rate of steam at 320° C., tons/hour | — | 3 |
| Feed rate of gasoline at 150° C., t/h | — | 30 |
| Temperature of mixture, °C. | — | 825 |
| Downstream zone of reactor: | | |
| Feed rate of steam at 320° C., tons/hour | 9 | 6 |
| Feed rate of feedstock A or B at 380° C., tons/hour | 90 | 60 |
| Temperature of mixture, °C. | 785 | 780 |
| Temperature at end of reaction, °C. | 740 | 750 |
| Quench zone: | | |
| Temperature of effluents after ballistic separation, °C. | 730 | 740 |
| Temperature of feedstock, °C. | 80 | 90 |
| Temperature of mixture, °C. | 450 | 470 |
| Particle concentration in effluents, wt. % | 3.2 | 2.2 |
| Temperature of fractionation-residue fraction, °C. | 420 | 440 |

After recovery of the effluents from the steam-cracking reaction, the nature of these effluents was analyzed. The results of that analysis (in weight percent), presented below, alone demonstrate the advantages of the present invention over the conventional processes.

| | FEEDSTOCK A | FEEDSTOCK B |
|---|---|---|
| $H_2S + NH_3$ | 0.90 | 0.80 |
| $H_2$ | 0.90 | 0.70 |

-continued

| | FEEDSTOCK A | FEEDSTOCK B |
|---|---|---|
| $C_1$ | 7.90 | 9.70 |
| $C_2$ | 5.60 | 5.90 |
| $C_2$ (olefinic) | 20.50 | 25.30 |
| $C_3$ | 0.5 | 0.60 |
| $C_3$ (olefinic) | 11.00 | 11.00 |
| $C_4$ (olefinic) | 3.20 | 3.10 |
| $C_4$ (diolefinic) | 2.80 | 3.10 |
| $C_5$ –220° C. | 13.90 | 14.80 |
| 220–360° C. | 14.40 | 7.80 |
| >360° C. | 4.9 | 3.70 |
| Coke | 13.50 | 13.50 |

It is thus apparent from this example that the invention offers many advantages over the steam-cracking processes used up to now. In fact, with olefin yields at least equal to those of the most efficient units, it makes possible:

Utilization in the feedstock of distillation residues hitherto excluded from steam cracking.

Unequaled operating flexibility (feed rate, nature of feedstocks, etc.).

Continuous operation (without shutdown for decoking) and without additional energy (since the coke produced permits the heat balance of the unit to be maintained).

We claim:

1. A process for the steam cracking conversion of at least one respectively light hydrocarbon fraction having a low metal contamination and a boiling point of below about 400° C., and a respectively heavier hydrocarbon feedstock, which heavier feedstock comprises compounds having a boiling point of above about 400° C., said process taking place at high temperature and in the presence of a dilute fluidized phase of inert, or catalytic-cracking, heat-transfer particles, said process comprising, contacting the light hydrocarbon fraction and then the heavier feedstock, in a sequential manner and with decreasing temperature severity, with heat-transfer particles in a continuous upflow or downflow tubular reactor, separating and then stripping at least 90 percent of the particles from the effluent hydrocarbons derived from the contacted materials, which separated particles are then regenerated, by the combustion of essentially all coke content of the particles, before recycling the particles at a higher temperature to the inlet of the continuous-flow reactor, and which separated effluent hydrocarbons are then fractionated by distillation, the process further comprising injection into the effluent hydrocarbons of a quench/feed in the form of a heavier feedstock portion soon after the separation of the particles from the effluent hydrocarbons and well before the fractionation, the particle separation and quench injection being carried out in a manner to favor rapidity of separation of heat-transfer particles and the rapidity of cooling of the resulting effluent hydrocarbons to minimize undesirable side reactions and thus increase olefin product yield at the expense of efficiency or completeness of separation resulting in an excess of particles and particle fines in the effluent hydrocarbons and said quench being such that the effluents from the steam-cracking reaction are brought to a liquid state at a temperature range of from 300° to 450° C., in less than 0.3 second, essentially all of the particle-containing residue resulting from the fractionation being recycled back upstream of said fractionation, with all or at least a significant portion of the residue being recycled back into the downstream portion of the reactor as at least part of the heavier feedstock fed thereto and any remaining residue being recycled back as part of said quench and/or optionally some may be bled off; and at least a significant portion of said quench/feed being non-recycled heavier feedstock.

2. The process as defined in claim 1, wherein the heavier hydrocarbon feedstock is injected in the liquid state as atomized drops of a diameter of less than about 200 microns.

3. The process as defined in claim 2, wherein the atomized drops are of a diameter of less than about 100 microns, and the majority of the heavier hydrocarbon feedstock is injected into the effluent hydrocarbons after particle separation.

4. The process as defined in claim 1, wherein the effluents from the steam-cracking reaction are brought to a temperature below the dew point by means of injection of the quench/feed including recycled residue from the fractionation as the heavier feedstock portion.

5. The process defined in claim 1, wherein the effluent hydrocarbons to be fractionated contain from about 0.01 to 10 percent, by weight, of heat-transfer particles.

6. The process defined in claim 5, wherein the effluent hydrocarbons to be fractionated contain from about 0.5 to 5 percent, by weight, of heat-transfer particles.

7. The process as defined in claim 1, wherein prior to fractionation by distillation of the effluents from the steam-cracking reaction, the effluents are brought to a temperature range of from 300° to 450° C.

8. The process, as defined in claim 1, wherein the effluents are brought to the liquid state, at a temperature range of from 300° to 450° C., in less than 0.1 second.

9. The process as defined in claim 1, wherein the heavier hydrocarbon feedstock is chosen from the group consisting of the residues from atmospheric or vacuum distillation, catalyst slurries, pitches from deasphalting, synthetic and reclaimed oils.

10. The process as defined in claim 1, wherein the distillation-residue fraction recycled to the reactor is at a temperature of less than 100° C. below the temperature of the bubble point of that fraction.

11. The process as defined in claim 10, wherein the distillation residue fraction recycled to the reaction is at a temperature of less than 50° C. below the temperature of the bubble point of that fraction.

12. The process as defined in claim 1, wherein the heavy liquid feedstock consists at least in part of a portion of the distillation residue from fractionation.

13. The process as defined in claim 12, wherein the distillation residue from the fractionation is cooled by heat exchange upon its exit from the fractionating column.

14. The process as defined in claim 1, wherein the light hydrocarbon fraction is chosen from the group consisting of light paraffins, ethane, propane, butane, gasolines, naphthas and gas oils.

15. The process as defined in claim 14 further comprising the injection upstream into the reactor, of a plurality of light hydrocarbon fractions, wherein the injection of said fractions is effected in a sequential manner, in an order of decreasing severity.

16. The process as defined in claim 15, wherein light gases, selected from the group consisting of ethane, propane or butane, are injected successively from upstream to downstream, into the reactor, in such quantity that the temperature of the heat-transfer particle mixture remains above 800° C., and hydrocarbon fractions such as light gasolines, naphthas or gas oils are then injected, in such quantity that the temperature of the mixture directly downstream of the point of injection is above 750° C., and then a fraction of the distillation residue is injected to bring the reaction temperature to a temperature range of from 650° to 750° C.

17. The process as defined in claim 16, wherein the temperature of the mixture directly downstream is above 800° C.

18. The process as defined in claim 1, wherein a portion of light gases which are produced by the steam cracking is recycled to the reactor.

19. The process as defined in claim 1, wherein an operating pressure for the reaction is applied which ranges from 0.3 to 5 kg/cm$^2$.

20. The process as defined in claim 4, wherein the quenching heavier feedstock at least partially contains recycled residue from the distillation fractionation.

21. The process as defined in claim 1, wherein fresh particles are added to the effluent hydrocarbons immediately after separation and prior to the quenching injection with heavier hydrocarbons.

* * * * *

UNITED STATES PATENT AND TRADEMARK OFFICE

CERTIFICATE OF CORRECTION

PATENT NO. : 5,538,625

DATED : July 23, 1996

INVENTOR(S) : Sigaud et al

It is certified that error appears in the above-indentified patent and that said Letters Patent is hereby corrected as shown below:

On the title page: Item [30] should be inserted to read --PCT/FR89/00437 September 1, 1989 [WO] WIPO--.

Signed and Sealed this

Third Day of December, 1996

*Attest:*

*Attesting Officer*

BRUCE LEHMAN

*Commissioner of Patents and Trademarks*